US008348368B2

(12) United States Patent
Kim et al.

(10) Patent No.: US 8,348,368 B2
(45) Date of Patent: Jan. 8, 2013

(54) METHOD FOR ARRAYING HEAD ASSEMBLIES OF INKJET PRINTER AND APPARATUS FOR PERFORMING THE SAME

(75) Inventors: Minhyung Kim, Suwon-si (KR); Sangyoung Jin, Suwon-si (KR); Sangchul Seo, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 574 days.

(21) Appl. No.: 12/634,901

(22) Filed: Dec. 10, 2009

(65) Prior Publication Data

US 2010/0207980 A1 Aug. 19, 2010

(30) Foreign Application Priority Data

Feb. 17, 2009 (KR) ..... 10-2009-0012931

(51) Int. Cl.

| | |
|---|---|
| ***B41J 29/38*** | (2006.01) |
| ***B41J 2/15*** | (2006.01) |
| ***B41J 2/145*** | (2006.01) |
| ***B41J 2/155*** | (2006.01) |

(52) U.S. Cl. ..... 347/12; 347/9; 347/13; 347/40; 347/42

(58) Field of Classification Search ..... 347/12
See application file for complete search history.

(56) References Cited

U.S. PATENT DOCUMENTS

| | | | | |
|---|---|---|---|---|
| 2002/0044163 | A1* | 4/2002 | Shigemura | 347/1 |
| 2006/0092199 | A1 | 5/2006 | White et al. | |
| 2006/0092219 | A1 | 5/2006 | Kurita et al. | |

FOREIGN PATENT DOCUMENTS

| | | | |
|---|---|---|---|
| JP | 2001-330720 | A | 11/2001 |
| JP | 2002-082216 | A | 3/2002 |
| JP | 2004-178174 | A | 6/2004 |

(Continued)

OTHER PUBLICATIONS

Notice of Allowance dated Jan. 17, 2011 of corresponding Korean Patent Application No. 10-2009-0012931—5 pgs.

*Primary Examiner* — Uyen Chau N Le
*Assistant Examiner* — Kajli Prince
(74) *Attorney, Agent, or Firm* — Knobbe Martens Olson & Bear LLP

(57) ABSTRACT

A method for arraying head assemblies of an inkjet printer and an apparatus used for the method that can reduce a period of time taken to array the head assemblies after the head assemblies are mounted in the inkjet printer by adjusting height and rotation center of each of the head assemblies before the head assemblies are mounted in the inkjet printer, and can improve array precision of the head assemblies by adjusting a position in the X direction and a rotation angle of each of the head assemblies having already adjusted height and rotation center after the head assemblies are mounted in the inkjet printer, by adjusting a position in the Y direction of each of the head assemblies and can control an ink spray time. The method includes setting a reference height and a reference rotation center; adjusting a height and a rotation center of a head coupled to a head assembly using the reference height and the reference rotation center; mounting the head assembly in the inkjet printer; and adjusting a position of the head assembly and a rotation angle of the head assembly.

19 Claims, 9 Drawing Sheets

FOREIGN PATENT DOCUMENTS

| | | | |
|---|---|---|---|
| JP | 2006-198607 | A | 8/2006 |
| JP | 2007-036020 | A | 2/2007 |
| JP | 2008-198950 | A | 8/2008 |
| JP | 2008-229404 | A | 10/2008 |
| KR | 10-0545486 | B1 | 1/2006 |
| KR | 10-2006-0092987 | A | 8/2006 |
| KR | 10-2006-0098305 | A | 9/2006 |
| KR | 10-2007-0071257 | A | 7/2007 |
| KR | 10-2008-0015651 | A | 2/2008 |
| KR | 10-2008-0058685 | A | 6/2008 |
| KR | 10-2007-0057479 | A | 6/2009 |

* cited by examiner

METHOD FOR ARRAYING HEAD ASSEMBLIES OF INKJET PRINTER AND APPARATUS FOR PERFORMING THE SAME

CROSS-REFERENCE TO RELATED APPLICATION

This application claims the benefit of Korean Application No. 10-2009-0012931 filed Feb. 17, 2009, in the Korean Intellectual Property Office, the disclosure of which is incorporated herein by reference.

BACKGROUND OF THE INVENTION

1. Field of the Invention

Aspects of the present invention relate to a method for arraying head assemblies of an inkjet printer, and an apparatus used for performing the method.

2. Description of the Related Art

In general, in an inkjet printer having a single-head assembly, arraying the head assembly takes a relatively short time, but performing a printing operation using the head assembly takes a relatively long time. Contrarily, in an inkjet printer having multi-head assemblies, arraying the multi-head assemblies takes a relatively long time, but performing a printing operation using the multi-head assemblies takes a relatively short time. Therefore, the inkjet printers having the multi-head assemblies are more widely used due to a shorter period of time to perform the print operation.

However, in the inkjet printer having the multi-head assemblies, increasing the number of head assemblies causes array efficiency of the head assemblies to decrease such that arraying the head assemblies takes more time when the number of head assemblies is increased.

Also, when the head assemblies are firstly disposed or replaced in the inkjet printer having multi-head assemblies, each of the multi-head assemblies adjusts positions in X, Y, and Z directions, a rotation angle, and a rotation center thereof. Therefore, the inkjet printer having multi-head assemblies takes too much time to perform adjustments of the positions in X, Y, and Z directions, rotation angles, and rotation centers thereof.

SUMMARY OF THE INVENTION

Therefore, aspects of the present invention have been made in view of the above problems, and aspects of the present invention provide a method for arraying head assemblies of an inkjet printer that can reduce a period of time taken to array the head assemblies in the inkjet printer by adjusting height and rotation center of each of the head assemblies before the head assemblies are mounted in the inkjet printer, and an apparatus that can be used for performing the array method.

Aspects of the present invention also provide a method for arraying head assemblies of an inkjet printer that can improve array precision of the head assemblies by adjusting a height and a rotation center of each of the head assemblies before the head assemblies are mounted in the inkjet printer, and then adjusting a rotation angle and a position in the X direction of each of the head assemblies after the head assembly is mounted in the inkjet printer, and by adjusting a position in the Y direction of the head assembly by controlling an ink spray time, and an apparatus that can be used for performing the array method.

In accordance with an aspect of the present invention, there is provided a method for arraying head assemblies of an inkjet printer including: setting a reference height and a reference rotation center; adjusting a height and a rotation center of a head coupled to a head assembly using the reference height and the reference rotation center; mounting the head assembly in the inkjet printer; and adjusting a position of the head assembly and a rotation angle of the head assembly.

The setting the reference height and the reference rotation center may include: attaching a reference jig to a rotation device of a preliminary array apparatus having a photographing unit and a flatness measuring unit disposed at a bottom thereof, the rotation device disposed at a top of the preliminary array apparatus; adjusting the flatness of the reference jig using the flatness measuring unit; measuring a height of the reference jig after adjusting the flatness of the reference jig; setting the measured height of the reference jig as a reference height; detecting a rotation center of the reference jig by rotating the rotation device; and setting the rotation center of the reference jig as a reference rotation center.

The flatness measuring unit used for measuring the height of the reference jig may include one of a laser displacement sensor and a dial gauge.

The detecting the rotation center of the reference jig may include: perceiving a point of the reference jig; rotating the reference jig approximately 360 degrees; perceiving three points from a same trace of the rotation; and perceiving a center of a circle formed from the three points as the rotation center of the reference jig.

The setting the rotation center of the reference jig as the reference rotation center may include: moving the photographing unit in the X, Y, and Z directions so that a center of the photographing unit is aligned with the rotation center of the reference jig.

The adjusting the height and the rotation center of the head coupled to the head assembly may include: attaching the head assembly to a rotation device disposed at the top of a preliminary array apparatus having a photographing unit and a flatness measuring unit disposed at a bottom thereof, aligning a center of the photographing unit with a rotation center of the rotation device; measuring the height of the head after the adjusting the flatness of the head of the head assembly using the flatness measuring unit; adjusting the height of the head of the head assembly to be the same as a predetermined reference height; detecting the rotation center of the head of the head assembly by rotating the rotation device; and adjusting the rotation center of the head of the head assembly to be located at a predetermined reference rotation center.

The adjusting the rotation center of the head of the head assembly may include moving the head of the head assembly in the X and Y directions so that the rotation center of the head is aligned with the center of the photographing unit.

The adjusting the position of the head assembly and the rotation angle of the head assembly may include: attaching the head assembly to a position adjusting member disposed at the top of the inkjet printer having a photographing unit disposed on a bottom thereof; photographing the position of the head assembly in the X and Y directions and the rotation angle of the head assembly; adjusting the position of the head assembly in the X direction and the rotation angle of the head assembly to be a predetermined reference position in the X direction and a reference rotation angle; and calculating ink spray time corresponding to the position of the head assembly in the Y direction of the head assembly and adjusting the ink spray time.

The position adjusting member to which the head assembly is attached may include: an X direction moving portion allowing the head assembly to move in the X direction; and a rotating portion allowing the head assembly to rotate.

The adjusting the position of the head assembly in the X direction and rotation angle of the head assembly may be performed by the position adjusting member.

In accordance with another aspect of the present invention, there is provided a head assembly array apparatus usable with an inkjet printer including: a stage on which a substrate is located; a main guide rail disposed on the stage and extending in the Y direction of the inkjet printer; a sub-guide rail disposed on the main guide rail and extending in the X direction; a Y direction moving member disposed between the main guide rail and the sub-guide rail, the Y direction moving member allowing the sub-guide rail to move in the Y direction; a plurality of position adjusting members disposed at the sub-guide rail to move in the X direction and to rotate; a head assembly disposed at each of the plurality of position adjusting members, a position in the X direction and a rotation angle of the head assembly adjusted by the position adjusting member; and a photographing unit disposed on the stage to photograph a position of the head assembly in the X and Y direction and the rotation angle of the head assembly.

The plurality of position adjusting members may adjust the position of the head assembly in the X and Y direction and the rotation angle of the head assembly to be a predetermined reference position in the X direction and a reference rotation angle according to the position of the head assembly in the X and Y direction and the rotation angle of the head assembly photographed by the photographing unit.

The position adjusting member may include: an X direction moving portion disposed on the sub-guide rail, the X direction moving portion allowing the head assembly to move in the X direction; and a rotating portion disposed at the X direction moving portion, the rotating portion allowing the head assembly to rotate.

With a method for arraying head assemblies of an inkjet printer according to aspects of the present invention and an apparatus used for the method, before the head assemblies are mounted in the inkjet printer, height and rotation center of each of the head assemblies are arrayed so that a period of time taken to array the head assemblies after the head assemblies are mounted in the inkjet printer may be reduced.

Furthermore, with a method for arraying head assemblies of an inkjet printer according to aspects of the present invention and an apparatus used for the method, height and rotation center of each of the head assemblies are adjusted before the head assemblies are mounted in the inkjet printer, a position in the X direction and a rotation angle of each of the head assemblies are adjusted after the head assemblies are mounted in the inkjet printer, and a position in the Y direction of each of the head assemblies is adjusted by controlling an ink spray time. Therefore, array precision of the head assemblies may be improved.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
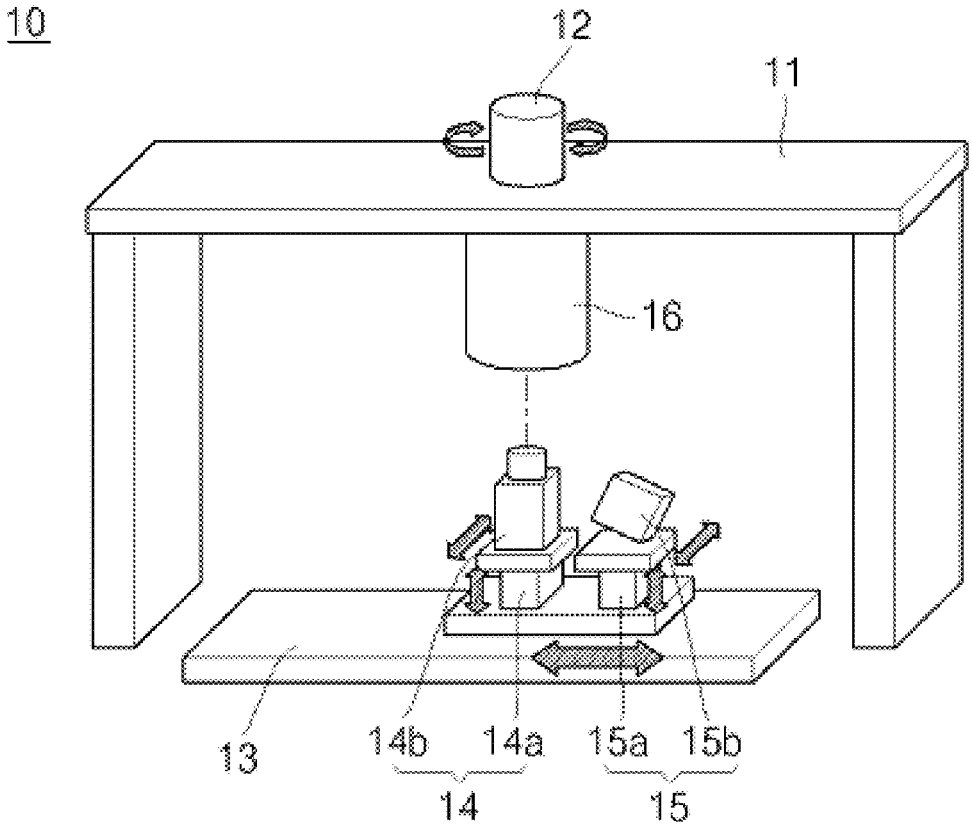
FIG. 1A is a front view of a preliminary array apparatus for a head assembly array apparatus usable with an inkjet printer according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 1B:
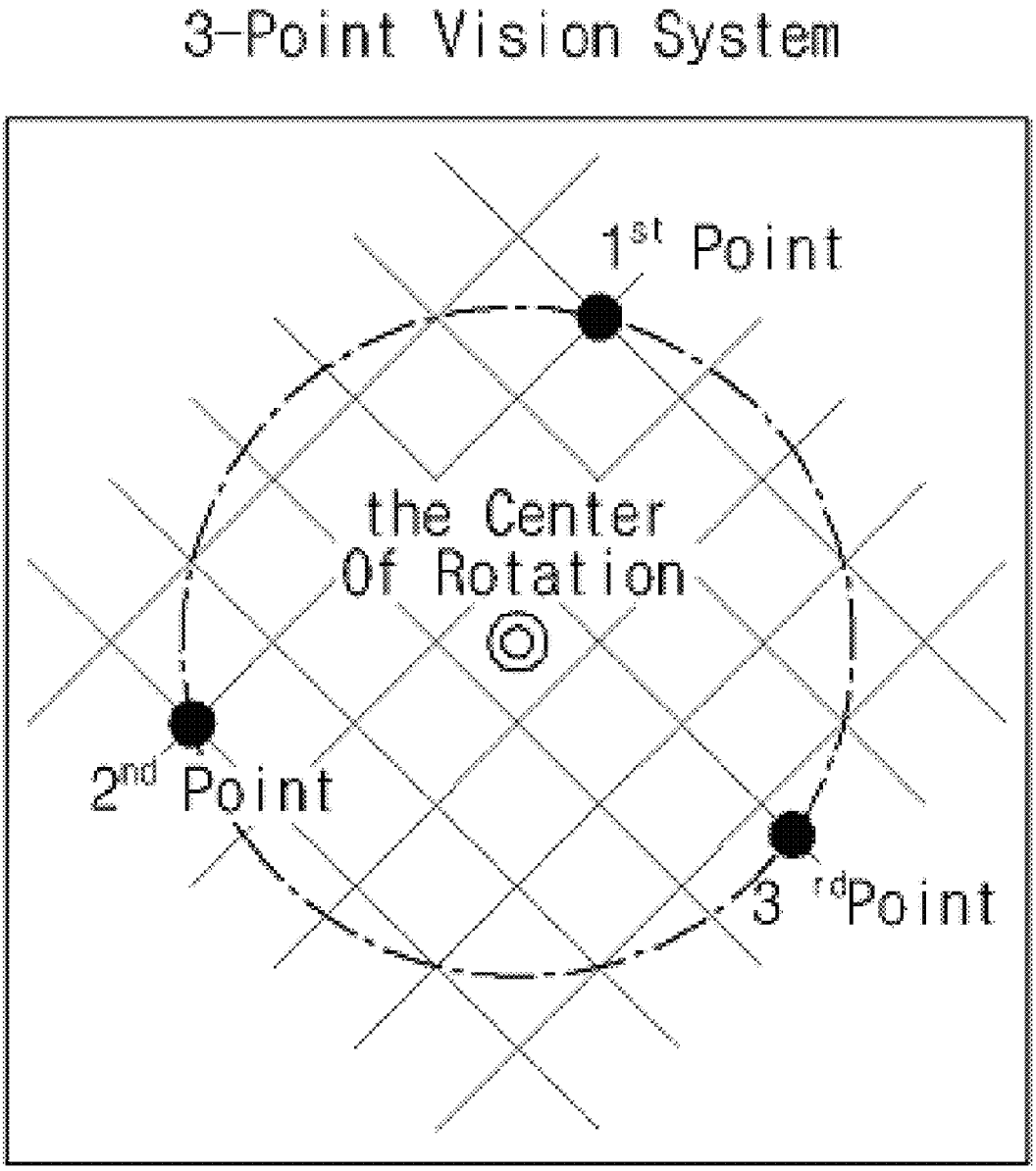
FIG. 1B is a view illustrating a method for detecting a rotation center of a reference jig coupled in a preliminary array apparatus.

FIG. 1A is a front view of a preliminary array apparatus for a head assembly array apparatus usable with an inkjet printer according to an embodiment of the present invention. FIG. 1B is a view illustrating a method for detecting a rotation center of a reference jig coupled in a preliminary array apparatus As illustrated in FIG. 1A, the preliminary array apparatus 10 may include a top support base 11, a rotation device 12, a bottom support base 13, a photographing unit 14, and a flatness measuring unit 15.

The top support base 11 may be formed substantially in a "Π" shape, for example, a bridge shape, and may be disposed over the bottom support base 13.

The rotation device 12 is disposed on the top support base 11. The reference jig 16 or a head assembly may be detachably disposed at the rotation device 12. Here, the rotation device 12 may be manually rotated. Alternatively, the rotation device 12 may be configured to be automatically rotated by a motor.

The bottom support base 13 is disposed below the top support base 11.

The photographing unit 14 is disposed on the bottom support base 13, and photographs a bottom surface of the reference jig 16 or the head assembly coupled to the rotation device 12. The photographing unit 14 may include a first XYZ directions moving member 14*a* that is disposed on the bottom support base 13 and can move in the X, Y, and Z directions, and a camera 14*b* disposed on the first XYZ directions moving member 14*a*.

The flatness measuring unit 15 is disposed on the bottom support base 13, and may measure height and flatness of the reference jig 16 coupled to the rotation device 12. The flatness measuring unit 15 may include a second XYZ directions moving member 15*a* that is disposed on the bottom support base 13 and can move in the X, Y, and Z directions, and a flatness measuring instrument 15*b* disposed at the second XYZ directions moving member 15*a*. The flatness measuring instrument 15*b* may be one selected among a laser displacement sensor, a dial gauge, and equivalents thereof. However, this does not limit kinds of the flatness measuring instrument 15*b*.

The first XYZ directions moving member 14*a* of the photographing unit 14 and the second XYZ directions moving member 15*a* of the flatness measuring unit 15 may be a mechanical structure that can move in the X, Y, or Z direction. The mechanical structure may be well-known to those of ordinary skill in the art; therefore, detailed descriptions thereof will be omitted.

The preliminary array apparatus 10 may be used to set a reference height and a reference rotation center using the reference jig 16.

For this, using the reference jig 16, the reference height and reference rotation center are set. For example, the reference jig 16 is mounted at a bottom end of the rotation device 12 of the preliminary array apparatus 10. Then, using the flatness measuring instrument 15*b*, the flatness of the reference jig 16 is precisely adjusted, and then the height of the reference jig 16 with the adjusted flatness is measured. The height of the reference jig 16 may be used as a reference height or a standard height with respect to height of a head of the head assembly as described below.

After that, the rotation device 12 is operated to detect a rotation center of the reference jig 16. For example, as illustrated in FIG. 1B, the camera 14*b* perceives a point of the reference jig 16, and then the rotation device 12 rotates the reference jig 16 approximately 360 degrees so that the point of the reference jig 16 forms a trace. Then the camera 14*b* selects three points from the trace and perceives the center of a circle formed from the three points as a rotation center of the reference jig 16.

After the rotation center is detected, the first XYZ directions moving member 14*a* allows the camera 14*b* to move in the X, Y, and Z directions so that the center of the camera 14*b* is aligned with the rotation center of the reference jig 16. The center of the camera 14*b* perceived by the above-described process may be used as a reference rotation center or a standard rotation center.

Figure 2:
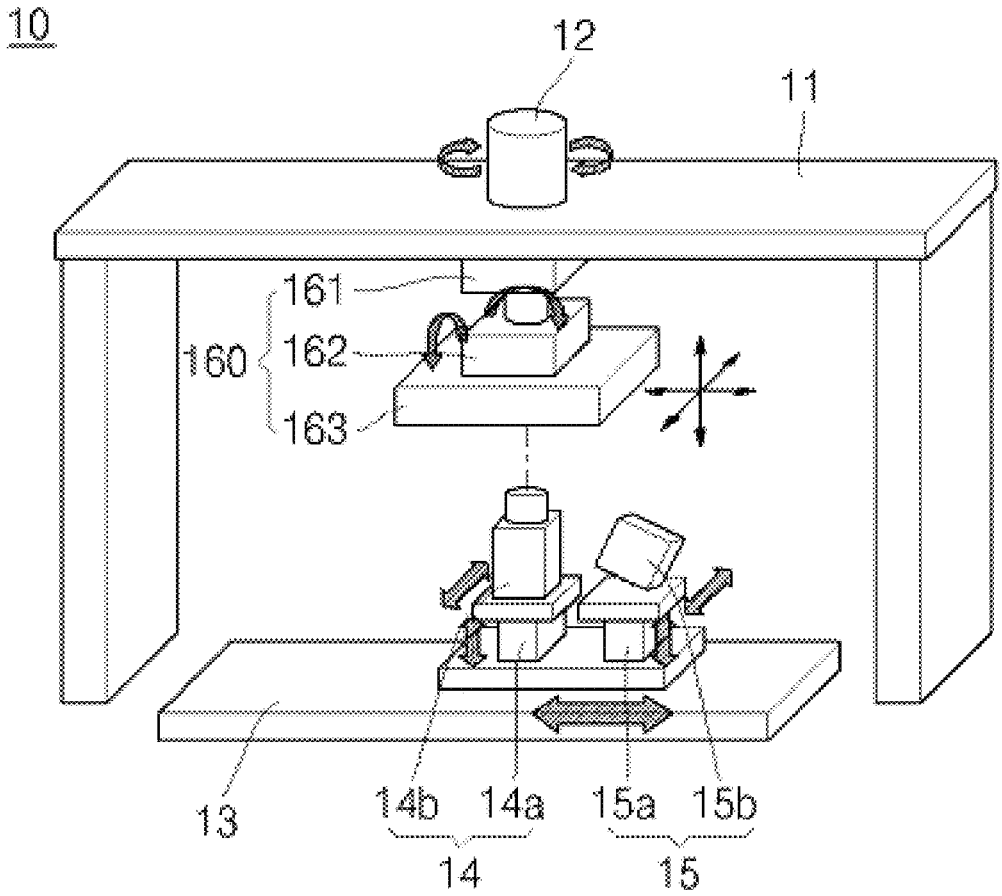
FIG. 2 is a front view illustrating a head assembly coupled in a preliminary array apparatus for a head assembly array apparatus usable with an inkjet printer according to an embodiment of the present invention.

FIG. 2 is a front view illustrating the head assembly coupled in the preliminary array apparatus for a head assembly array apparatus usable with an inkjet printer according to an embodiment of the present invention.

As illustrated in FIG. 2, after the reference jig 16 is removed from the rotation device 12 of the preliminary array apparatus 10, the head assembly 160 is coupled thereon. The head assembly 160 may include a XYZ directions moving member 161 that is coupled to the rotation device 12 and/or at a position adjusting member of the head assembly array apparatus usable with an inkjet printer and can move in the X, Y, and Z directions, a tilting angle adjusting member 162 that is coupled to the XYZ directions moving member 161 and can adjust a tilting angle, and a head 163 that is coupled to the tilting angle adjusting member 162 and can spray ink. Here, the XYZ directions moving member 161 may be a mechanical structure that can move in the X, Y, or Z direction, and the tilting angle adjusting member 162 may be a mechanical structure that can rotate by predetermined angles. The mechanical structure may be well-known to those of ordinary skill in the art; therefore, detailed descriptions thereof will be omitted.

On the other hand, the preliminary array apparatus 10 is used to adjust the height of the head 163 of the head assembly 160 to be the reference height, and to adjust the rotation center of the head 163 to be the reference rotation center before the head assembly 160 is coupled in the head assembly array apparatus usable with an inkjet printer.

For this, first, the head assembly 160 is attached at the bottom end of the rotation device 12 of the preliminary array apparatus 10. After that, using the flatness measuring instrument 15*b*, the flatness of the head 163 of the head assembly 160 is accurately adjusted by the tilting angle adjusting member 162. Then using again the flatness measuring instrument 15*b*, the height of the head 163 of the head assembly 160 is adjusted to be a predetermined height of the reference jig 16 by the XYZ directions moving member 161. That is, the height of the head 163 of the head assembly 160 is adjusted to be the reference height. At this time, the XYZ directions moving member 161 only moves in the Z direction.

Next, when operating the rotation device 12, a rotation center of the head 163 of the head assembly 160 is detected. The detected rotation center of the head 163 of the head assembly 160 is moved to the predetermined center of the camera 14*b* by the XYZ directions moving member 161. That is, the XYZ directions moving member 161 moves the head 163 in the X and Y directions so that the rotation center of the head 163 is aligned with the predetermined center of the camera 14*b*. Of course, the center of the camera 14*b* is the same position as that of the predetermined reference rotation center. Therefore, the rotation center of the head 163 of the head assembly 160 is adjusted to be the reference rotation center.

The above-described procedure allows the head assembly 160 to have flatness, height, and rotation center accurately adjusted before being mounted in the inkjet printer. As a result, when the head assembly 160 is mounted in the inkjet printer, a period of time to array the head assembly 160 may be reduced.

Figure 3:
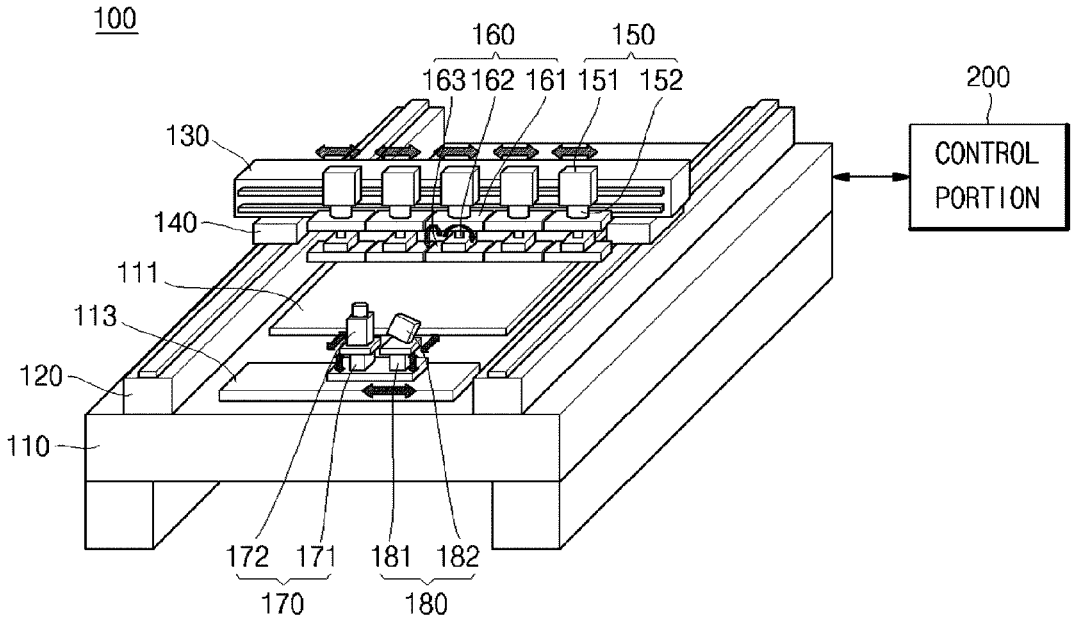
FIG. 3 is a perspective view illustrating a head assembly array apparatus usable with an inkjet printer according to an embodiment of the present invention.

FIG. 3 is a perspective view illustrating the head assembly array apparatus usable with an inkjet printer according to aspects of the present invention.

As illustrated in FIG. 3, the head assembly array apparatus 100 usable with an inkjet printer may include a stage 110, a main guide rail 120, a sub-guide rail 130, a Y direction moving member 140, the position adjusting members 150, the head assemblies 160, a photographing unit 170, and a control portion 200.

The stage 110 may have an approximately flat top surface. A substrate 111 on which printing is performed is located on the top surface of the stage 110. The substrate 111 may include a liquid crystal display (LCD) substrate, a plasma display panel (PDP) substrate, an organic light emitting diode (OLED) substrate, etc., however, aspects of the present invention are not limited to such types of substrates. In other words, a sheet of paper, a piece of cloth, a plastic, a metal or other similar material, substance or objects may be located on the top surface of the stage 110 instead of the substrate 111. Also, color filters, electromagnetic wave shielding filters, black matrixes, organic thin films, inorganic thin films, or other equivalents thereof, may be printed on the substrate 111, however, types of the printing are not limited hereto.

The main guide rail 120 is disposed on the top surface of the stage 110. In other words, the main guide rail 120 extends at a predetermined length in the Y direction of the stage 110 (a direction from a front side to a rear side in FIG. 2). The main guide rail 120 may also be formed in a pair of guide rails spaced apart from each other. The substrate 111 may be located between the pair of main guide rails 120.

The sub-guide rail 130 is disposed on the main guide rail 120 and is substantially in the X direction. The sub-guide rail 130 moves along the main guide rail 120 substantially in the Y direction.

The Y direction moving member 140 is disposed between the main guide rail 120 and the sub-guide rail 130. The Y direction moving member 140 allows the sub-guide rail 130 to move above the main guide rail 120 in the Y direction. The Y direction moving member 140 may include a general guide block coupled to the sub-guide rail 130.

The coupling structure of the main guide rail 120, sub-guide rail 130, and Y direction moving member 140, as illustrated in FIG. 3, is an exemplary illustration and aspects of the present invention are not limited thereto. Various mutual coupling structures, such as driving motor and transporting belts, driving motor and transporting screws, or other similar coupling structures, may be used.

A plurality of position adjusting members 150 may be arranged on the sub-guide rail 130 at predetermined intervals in a line, and may move along the sub-guide rail 130 in the X direction. The position adjusting member 150 may include an X direction moving portion 151 that is coupled in the sub-guide rail 130 and moves in the X direction, and a rotating portion 152 that is coupled to the X direction moving portion 151 and allows the head assembly 160 to rotate at predetermined angles. The position adjusting member 150 may be formed of one selected among a motor, a cylinder, and equivalents thereof. However, this does not limit kinds of the position adjusting member 150. Also, the X direction moving portion 151 of the position adjusting member 150 is coupled in the sub-guide rail 130, and carries the head assembly 160 in the horizontal direction, that is, in the X direction. The mechanical structures of the X direction moving portion 151 and the rotating portion 152 may be modified or changed by those of ordinary skill in the art, and therefore, aspects of the present invention are not limited to the mechanical structures of the X direction moving portion 151 illustrated in FIG. 3.

The head assembly 160 is coupled to the position adjusting member 150. As described above, the head assembly 160 may include the XYZ directions moving member 161 moving in the X, Y, and Z directions, the tilting angle adjusting member 162 that is coupled to the XYZ directions moving member 161 to adjust the tilting angle, and the head 163 that is coupled to the tilting angle adjusting member 162 to spray ink on the substrate 111.

The photographing unit 170 is disposed on the stage 110 between the main guide rails 120, and photographs the bottom surface of the head assembly 160. In more detail, the photographing unit 170 is disposed on a bottom support base 113 formed on the stage 110. In other words, the photographing unit 170 may include a third XYZ directions moving member 171 disposed on the bottom support base 113 that move in the X, Y, and Z directions, and a camera 172 disposed on the third XYZ directions moving member 171.

A flatness measuring unit 180 also may be disposed on a side of the photographing unit 170. The flatness measuring unit 180 may include a fourth XYZ directions moving member 181 that is disposed on the bottom support base 113 and can move in the X, Y, and Z directions, and a flatness measuring instrument 182 disposed on the fourth XYZ directions moving member 181. The flatness measuring unit 180 may be scarcely used in the inkjet printer except that the flatness and height of the head assembly 160 need to be checked.

The control portion 200 may be electrically connected with the Y direction moving member 140, the position adjusting members 150, the head assemblies 160, the photographing unit 170, and the flatness measuring unit 180, and may directly or indirectly control them. The control portion 200 may be configured by a personal computer, a micro computer, a programmable logic controller (PLC), and equivalents thereof, however, aspects of the present invention are not limited thereto.

Figure 4:
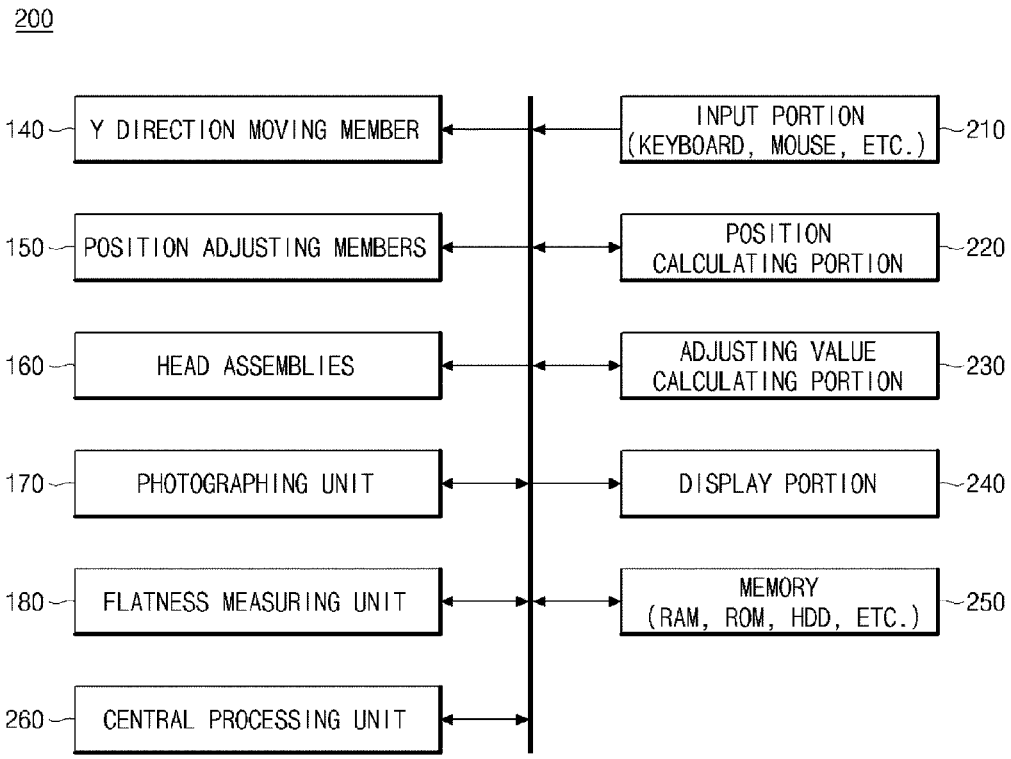
FIG. 4 is a block diagram illustrating a control portion for controlling a head assembly array apparatus usable with an inkjet printer according to an embodiment of the present invention.

FIG. 4 is a block diagram illustrating the control portion 200 for controlling the head assembly array apparatus usable with an inkjet printer according to an embodiment of the present invention. FIG. 4 illustrates only parts required to explain operation of aspects of the present invention, and the control portion 200 may include other parts in addition to those illustrated in the FIG. 4. The Y direction moving member 140, the position adjusting members 150, the head assemblies 160, the photographing unit 170, and the flatness measuring unit 180 are regarded as parts of the control portion 200 for explaining aspects of the present invention. Furthermore, FIG. 3 is referred to for explaining the present invention.

As illustrated in FIG. 4, the control portion 200 of the head assembly array apparatus usable with an inkjet printer may include the Y direction moving member 140, the position adjusting members 150, the head assemblies 160, the photographing unit 170, the flatness measuring unit 180, an input portion 210, a position calculating portion 220, an adjusting value calculating portion 230, a display portion 240, a memory 250, and a central processing unit 260. As illustrated in FIG. 4, the above-described parts are connected to each other via data buses, however, aspects of the present invention are not limited thereto.

The Y direction moving member 140 causes the sub-guide rail 130 to move above the main guide rail 120 in the Y direction according to a control command or instruction from the central processing unit 260. In fact, the central processing unit 260 controls motors, cylinders, or other such mechanical elements, to move the Y direction moving member 140. That is, when the central processing unit 260 controls the motor, cylinder, etc., the Y direction moving member 140 moves a predetermined distance in the Y direction above the main guide rail 120. The movement of the Y direction moving member 140 allows the position adjusting member 150 and the head assembly 160 disposed on the sub-guide rail 130 to be moved in the Y direction.

According to the control command of the central processing unit 260, the position adjusting member 150 adjusts a position in the X direction and a rotation angle of each of the head assemblies 160 based on an adjusting value calculated by the adjusting value calculating portion 230. The central processing unit 260 operates the X direction moving portion 151 of the position adjusting member 150 so that each of the head assemblies 160 is located at an original position in the X direction. For example, a spacing distance in the X direction, between the two head assemblies 160, is adjusted to be equivalent to a reference spacing distance in the X direction. The central processing unit 260 operates the rotating portion 152 of the position adjusting member 150 to remove the rotation angle of the head assembly 160. That is, the rotation angle is adjusted to be approximately zero (0) degrees. The operation of the position adjusting member 150 allows the spacing distances in the X direction between all the head assemblies 160 to be adjusted to the reference spacing distance in the X direction and allows the rotation angles of all the head assemblies 160 to be adjusted to 0 degrees. On the other hand, it is difficult to mechanically adjust a position of the head assembly 160 in the Y direction. Therefore, the central processing unit 260 adjusts an ink spray time of the head assembly 160 as much as a period of time corresponding to the amount of error in the Y direction of the head assembly 160 stored in the memory 250 during a normal printing operation so that the position in the Y direction of the head assembly 160 is adjusted.

The head assembly 160 forms a predetermined amount of ink droplets on the substrate 111 according to the control command of the central processing unit 260. That is, the head assembly 160 applies predetermined electrical signals to nozzles provided to the head 163, thereby forming the predetermined amount of ink droplets on the substrate 111. Although, typically, the XYZ directions moving member 161 and the tilting angle adjusting member 162 of the head assembly 160 may operate corresponding to the control command of the central processing unit 260, when the position in the X, Y, and Z directions and the tilting angle of the head assembly 160 are already adjusted after the head assembly 160 is mounted in the inkjet printer, the XYZ directions moving member 161 and the tilting angle adjusting member 162 do not operate. However, as desired, the XYZ directions moving member 161 and the tilting angle adjusting member 162 may operate after the head assembly 160 is mounted in the inkjet printer.

The photographing unit 170 photographs the bottom surface of the head assembly 160 from below the head assembly 160 according to the control command of the central processing unit 260. That is, the photographing unit 170 photographs the position in the X and Y directions and the rotation angle of the head assembly 160. The image photographed by the photographing unit 170 is displayed in real time on the display portion 240 according to the control command of the central processing unit 260. Also, the third XYZ directions moving member 171 of the photographing unit 170 moves in a predetermined direction according to the control command of the central processing unit 260.

The flatness measuring unit 180 measures the height and flatness of the head assembly 160 from below the head assembly 160 according to the control command of the central processing unit 260. However, the flatness and height of the head assembly 160 are already adjusted so that after the head assembly 160 is mounted in the inkjet printer, the flatness measuring unit 180 does not operate. After the head assembly 160 is mounted in the inkjet printer, the flatness measuring unit 180 may be operated.

The input portion 210 allows predetermined commands or instructions to be inputted into the central processing unit 260. That is, a user may input various commands or instructions, select a menu, or input numerical values via the input portion 210. The input portion 210 may include a keyboard, a mouse, a scanner, and equivalents thereof; however, this does not limit aspects of the present invention.

The position calculating portion 220 automatically calculates the position in the X and Y directions and rotation angle of the head assembly 160 photographed by the photographing unit 170 according to the control command of the central processing unit 260.

For example, the position calculating portion 220 calculates a position in the Y direction of the head assembly 160, thereby automatically calculating the rotation angle of the head assembly 160. That is, a position in the Y direction of the leftmost area of the head assembly 160 is compared with a position in the Y direction of the rightmost area of the head assembly 160. The position calculating portion 220 uses the two positions in the Y direction to indirectly calculate the rotation angle of the head assembly 160. If the calculation produces a rotation angle of above zero degrees, the head assembly 160 may be rotated at a predetermined angle from the reference rotation angle.

As another example, the position calculating portion 220 automatically calculates positions in the Y direction of two nearest head assemblies 160. That is, a position in the Y direction of the rightmost area of one head assembly 160 is compared with a position in the Y direction of the leftmost area of the other head assembly 160. Then the position calculating portion 220 uses the two positions in the Y direction to indirectly calculate the size of a gap or a step in the Y direction between the two head assemblies 160. If the calculation produces the gap of a non-zero value, the two head assemblies 160 have the gap in the Y direction therebetween.

As another example, the position calculating portion 220 automatically calculates a spacing distance in the X direction between two nearest head assemblies 160. That is, a position in the X direction of the rightmost area of one head assembly 160 is compared with a position in the X direction of the leftmost area of the other head assembly 160. Then, the position calculating portion 220 uses the two positions in the X direction to indirectly calculate the spacing distance in the X direction between the two head assemblies 160. If the calculated spacing distance in the X direction between the two head assemblies 160 is different in size from the predetermined reference distance in the X direction, the two head assemblies 160 are not arrayed in the X direction. Therefore, the spacing distance in the X direction between the two head assemblies 160 needs to be adjusted.

According to the control command of the central processing unit 260, the adjusting value calculating portion 230 calculates adjusting values for each of the head assemblies 160 based on the values calculated by the position calculating portion 220.

For example, when each of the head assemblies 160 has a certain amount of rotation angle, the adjusting value calculating portion 230 calculates an additional amount of rotation angle of the head assembly 160 required to allow the certain amount of rotation angle to be zero. The additional amount of rotation angle is a value allowing the head assembly 160 to have the total rotation angle of zero degrees. The adjusting value is changed into an amount of angle required to rotate the rotating portion 152 of the position adjusting member 150.

As another example, when the size of the spacing distance in the X direction between the two nearest head assemblies 160 is different from the size of the reference spacing distance in the X direction, the adjusting value calculating portion 230 calculates a moving distance in the X direction of the head assembly 160 required to allow the size of the spacing distance in the X direction to be the same as the size of the reference spacing distance in the X direction. The moving distance in the X direction is an adjusting value to allow the two nearest head assemblies 160 to be set at the reference spacing distance in the X direction. The adjusting value is changed into a moving distance in an X direction of the X direction moving portion 151 required to move the X direction moving portion 151 of the position adjusting member 150.

As another example, if the two nearest head assemblies 160 have a gap or a step in the Y direction, the adjusting value calculating portion 230 calculates an ink spray time for each of the head assemblies 160 so that ink droplets sprayed from all the head assemblies 160 form a straight line parallel to the X direction regardless of the gaps in the Y direction. As described above, the gap in the Y direction of the head assembly 160 is difficult to mechanically adjust, because only the rotating portion 152 and the X direction moving portion 151 can adjust the rotation angle and position in the X direction of the head assembly 160, respectively. The sub-guide rail 130 carries the head assembly 160 in the Y direction, however, the sub-guide rail 130 carries all the head assemblies 160 in the Y direction at the same time so that it cannot adjust a gap in the Y direction of a specific head assembly 160. As a result, when some head assemblies 160 deviate from the reference position in the Y direction, all the head assemblies 160 operate as if all the head assemblies 160 are aligned in a straight line in the X direction by controlling ink spray times thereof. The memory 250 stores the deviation in the position in the Y direction of the head assembly 160 from the reference position in the Y direction. When performing a normal printing operation, the adjusting value calculating portion 230 adjusts the ink spray time of the deviated head assembly 160 by referring to the position in the Y direction of the deviated head assembly 160 stored in the memory 250. For example, when one head assembly 160 is at a different distance in the Y direction from the other head assemblies 160, the adjusting value calculating portion 230 controls an ink spray time in which the one head assembly 160 sprays ink earlier or later than the other head assemblies 160 spray ink, thereby producing an effect as if the one head assembly 160 is at the same distance in the Y direction as the other head assemblies 160.

The display portion 240 displays, in real time, images of the head assemblies 160 photographed by the photographing unit 170, a position calculating state, an adjusting value calculating state, a position adjusting state, or other related state information according to the control command of the central processing unit 260.

The memory 250 stores various data temporarily or permanently according to the control command of the central processing unit 260, and sends the stored data to the central processing unit 260. The memory 250 stores programs that perform various operations according to aspects of the present invention. The memory 250 also stores the reference rotation angle and the reference spacing distance in the X direction of the head assemblies 160 mounted in the inkjet printer. Furthermore, the memory 250 stores the ink spray time for the gap in the Y direction of the head assembly 160. The memory 250 may include a RAM, a ROM, a hard disc, a flash memory, a compact disc, or other fixed or removable information storage mediums, however, aspects of the present invention are not limited thereto.

Figure 5:
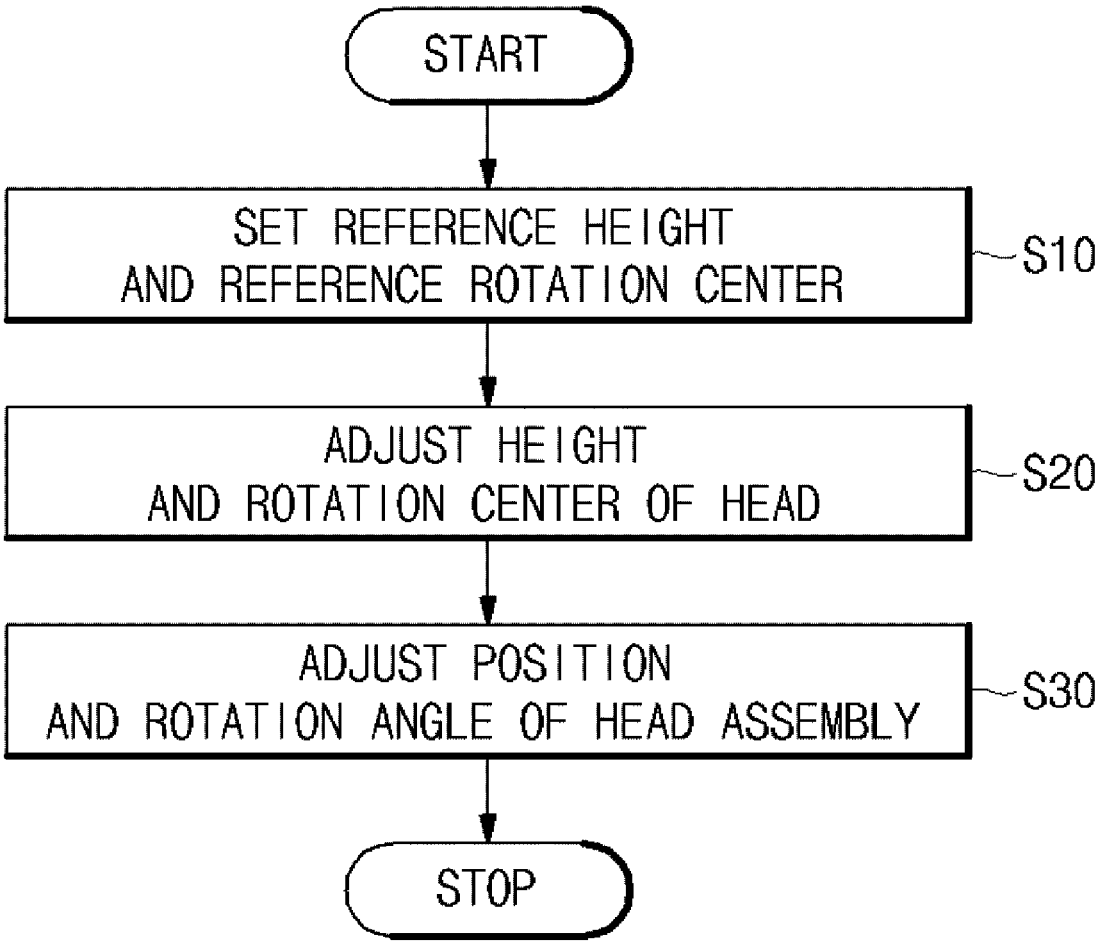
FIG. 5 is a flow chart illustrating a method for arraying head assemblies of an inkjet printer according to an embodiment of the present invention.

FIG. 5 is a flow chart illustrating a method for arraying head assemblies of an inkjet printer according to an embodiment of the present invention.

As illustrated in FIG. 5, the method for arraying head assemblies 160 of an inkjet printer according to aspects of the present invention may include a reference value setting step to set a reference height and a reference rotation center (S10), a head position adjusting step to adjust a height and a rotation center of the head (S20) coupled in the head assembly using the reference height and the reference rotation center, and a head assembly position adjusting step to adjust a position and a rotation angle of the head assembly (S30) coupled in the inkjet printer.

Figure 6:
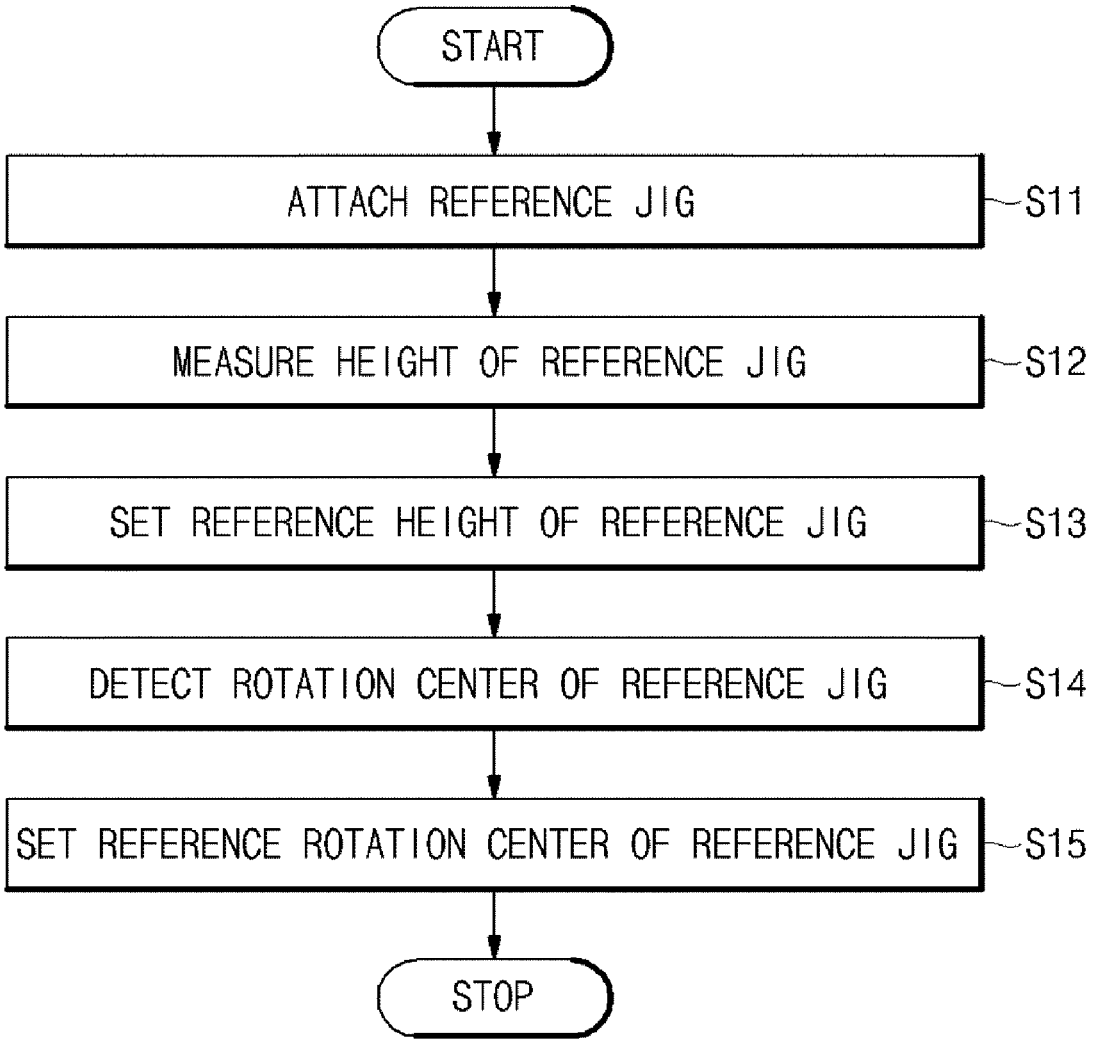
FIG. 6 is a flow chart illustrating a reference value setting step of a method for arraying head assemblies of an inkjet printer according to an embodiment of the present invention.

FIG. 6 is a flow chart illustrating the reference value setting step of a method for arraying head assemblies of an inkjet printer according to an embodiment of the present invention. In discussing FIG. 6 below, FIGS. 1A and 1B are referred to together.

As illustrated in FIG. 6, the reference value setting step may include the steps of attaching the reference jig (S11), measuring height of the reference jig (S12), setting the reference height of the reference jig (S13), detecting a rotation center of the reference jig (S14), and setting a reference rotation center of the reference jig (S15).

The preliminary array apparatus 10 is prepared at the step of attaching the reference jig (S11). The preliminary array apparatus 10 has the rotation device 12 disposed at the top thereof and the photographing unit 14 and the flatness measuring unit 17 disposed at the bottom thereof. After the preliminary apparatus 10 is prepared, the reference jig 16 is attached to the rotation device 12.

The flatness of the reference jig 16 is adjusted and then the height of the reference jig 16 is measured by using the flatness measuring unit 15 of the preliminary array apparatus at the step of measuring the height of the reference jig (S12). In other words, the flatness measuring unit 15 is used to adjust the reference jig 16 so that flatness in all directions parallel to the bottom plane of the reference jig 16 is the same, and then the height of the reference jig 16 is measured.

Here, the flatness measuring unit 15 for measuring the height of the reference jig 16 may be one of either a laser displacement sensor or a dial gauge or an equivalent gauge or sensor, however, aspects of the present invention are not limited thereto.

When setting the reference height of the reference jig (S13), the height of the reference jig 16 measured at the step S12 is set as the reference height. The reference height may be used as a reference height or a standard height with respect to the head 163 of the head assembly 160 as described below.

At the step of detecting the rotation center of the reference jig (S14), the rotation device 12 of the preliminary array apparatus 10 is rotated so that the rotation center of the reference jig 16 is detected.

That is, the camera 14*b* of the photographing unit 14 perceives a point of the reference jig 16, and then the rotation device 12 rotates the reference jig 16 approximately 360 degrees. Then the camera 14*b* perceives three points from the same trace and perceives the center of a circle formed from the three points as the rotation center of the reference jig 16.

The rotation center of the reference jig 16 detected at the step S14 is set as the reference rotation center when setting the reference rotation center of the reference jig (S15).

Setting the reference rotation center of the reference jig 16 is performed so that the first XYZ directions moving member 14*a* moves the camera 14*b* in the X, Y, and Z directions for the center of the camera 14*b* to be aligned with the rotation center of the reference jig 16. The XYZ position of the photographing unit 14 may be used as a reference value or a standard value when adjusting the rotation center of the head 163 of the head assembly 160 as described below.

Figure 7:
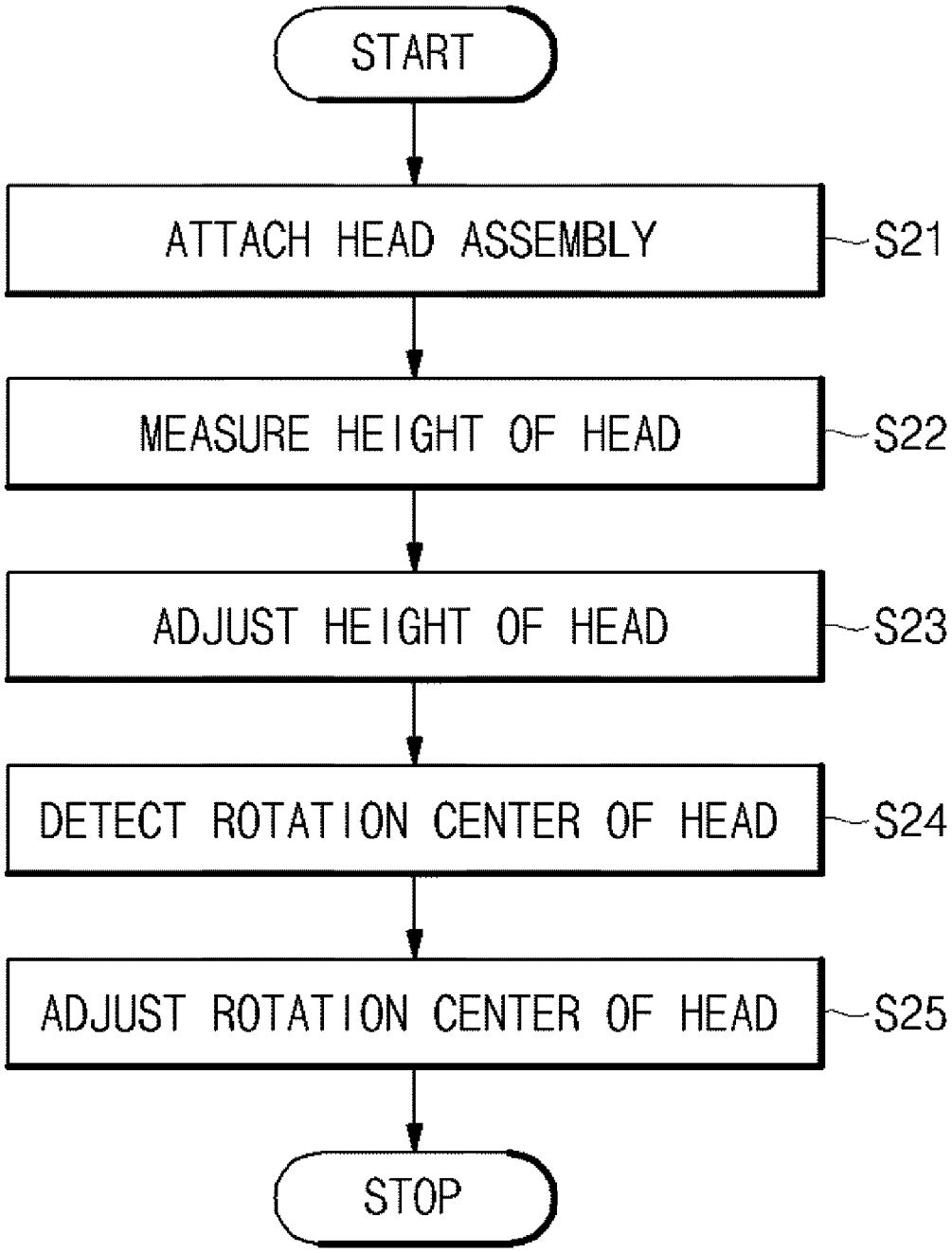
FIG. 7 is a flow chart illustrating a head position adjusting step of a method for arraying head assemblies of an inkjet printer according to an embodiment of the present invention.

FIG. 7 is a flow chart illustrating the head position adjusting step of the method for arraying head assemblies of an inkjet printer according to an embodiment of the present invention.

As illustrated in FIG. 7, the head position adjusting step may include the steps of attaching the head assembly (S21), measuring height of the head (S22), adjusting the height of the head (S23), detecting a rotation center of the head (S24), and adjusting the rotation center of the head (S25). In below the discussion of FIG. 7, reference is made to FIG. 2.

The preliminary array apparatus 10 is prepared when attaching the head assembly (S21). The preliminary array apparatus 10 has the rotation device 12 disposed at the top thereof, and the photographing unit 14 and the flatness measuring unit 15 disposed at the bottom thereof. At this time, the center of the photographing unit 14 is aligned with the rotation center of the rotation device 12. After that, the head assembly 160 is attached to the rotation device 12.

At the step of measuring the height of the head (S22), using the flatness measuring unit 15, the flatness of the head 163 of the head assembly 160 is adjusted, and then the height of the head 163 is measured. In other words the flatness measuring unit 15 is used to adjust the flatness of the head 163 of the head assembly 160 so that flatness in all directions parallel to the bottom plane of the head 163 becomes the same, and then the height of the head 163 is measured.

When adjusting the height of the head (S23), the head 163 of the head assembly 160 is adjusted so that the height of the head 163 becomes the same as the predetermined reference height. In other words, when adjusting the height of the head (S23), using the XYZ directions moving member 161 of the head assembly 160, the position in the Z direction of the head 163 is adjusted for the height of the head 163 to become the same as the reference height. That is, the height of the head 163 is adjusted to be the same as the height of the reference jig 16.

At the step of detecting the rotation center of the head (S24), while rotating the rotation device 12, the rotation center of the head 163 of the head assembly 160 is detected. At this time, the photographing unit 14 photographs the head assembly 160 from below the head assembly 160 and does not move. Since the center of the photographing unit 14 is aligned with the rotation center of the rotation device 12, the photographing unit 14 maintains a stationary state.

At the step of adjusting the rotation center of the head (S25), the rotation center of the head 163 of the head assembly 160 is adjusted to become the predetermined reference rotation center. That is, the XYZ directions moving member 161 of the head assembly 160 moves the head 163 in the X and/or Y directions so that the rotation center of the head 163 of the head assembly 160 is aligned with the center of the camera 14*b*, namely, the reference rotation center.

Figure 8:
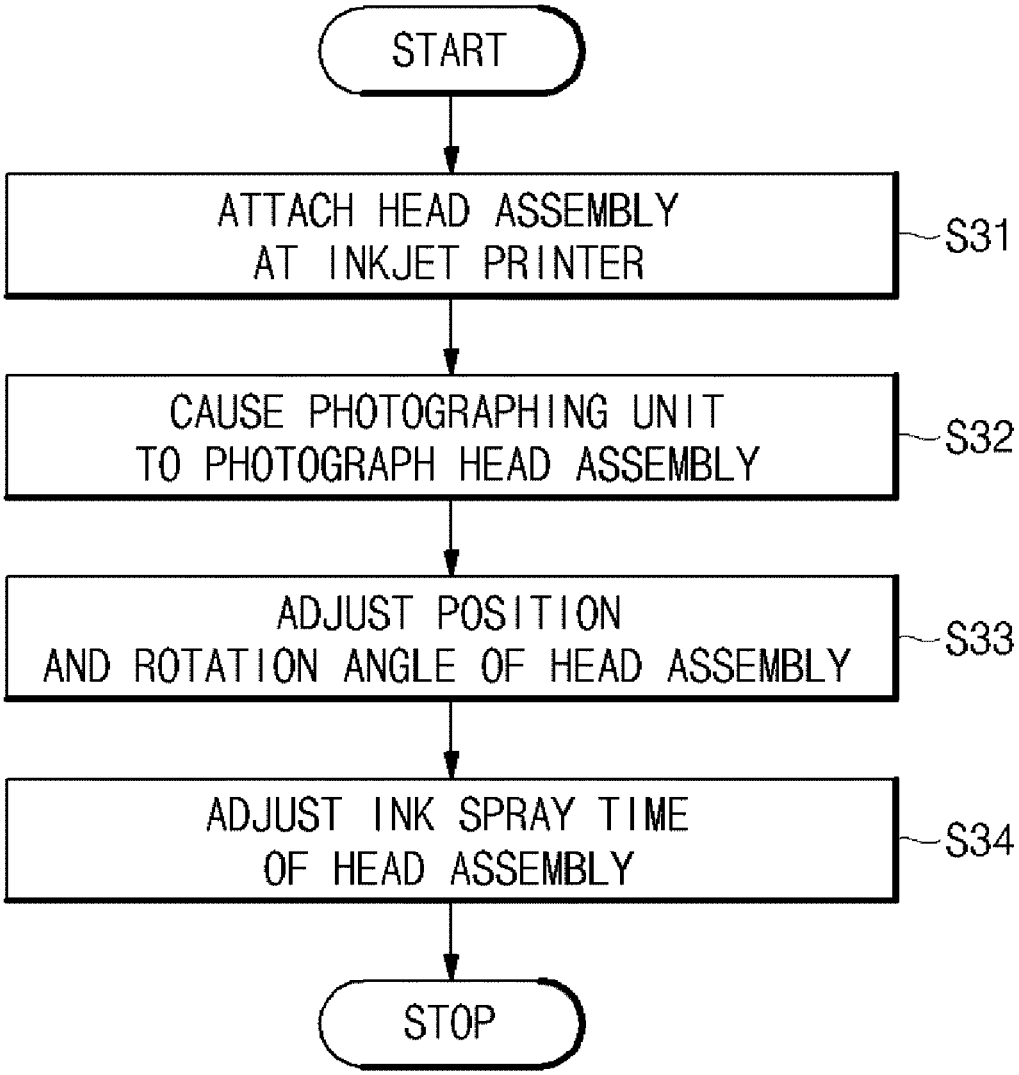
FIG. 8 is a flow chart illustrating a head assembly position adjusting step of a method for arraying head assemblies of an inkjet printer according to an embodiment of the present invention.

FIG. 8 is a flow chart illustrating the head assembly position adjusting step of the method for arraying head assemblies of an inkjet printer according to an embodiment of the present invention. In discussing FIG. 8 below, reference is made to FIG. 3.

As illustrated in FIG. 8, the head assembly position adjusting step may include the steps of attaching the head assembly at the inkjet printer (S31), photographing the head assembly (S32), adjusting the position and rotation angle of the head assembly (S33), and adjusting the ink spray time of the head assembly (S34).

An inkjet printer is prepared at the step of attaching the head assembly (S31). The inkjet printer has a position adjusting member 150 disposed on the top of the inkjet printer and a photographing unit 170 is disposed at the bottom of the inkjet printer. After that, head assemblies 160 are attached to the position adjusting member 150 and the height and rotation center of the head assemblies 160 are adjusted by the method as described above.

The position adjusting member 150 used to attach the head assembly (S31) may include an X direction moving portion 151 allowing the head assembly 160 to move in the X direction and a rotating portion 152 allowing the head assembly 160 to rotate.

At the step of photographing the head assembly (S32), the photographing unit 170 photographs the position in the X and Y directions and the rotation angle of the head assembly 160.

At the step of adjusting the position and rotation angle of the head assembly (S33), the position in the X direction and rotation angle of the head assembly 160 is adjusted to be the predetermined reference position in the X direction and the reference rotation angle. That is, the X direction moving portion 151 of the position adjusting member 150 moves the head assembly 160 to the predetermined reference position in the X direction, and the rotating portion 152 of the position adjusting member 150 rotates the head assembly 160 so that the rotation angle of the head assembly 160 becomes the predetermined reference rotation angle, namely, zero (0) degrees.

At the step of adjusting the ink spray time of the head assembly (S34), the ink spray time corresponding to the position in the Y direction of the head assembly 160 is calculated and adjusted. The position adjusting member 150 cannot allow the head assembly 160 to move in the Y direction. Therefore, adjustment of the gap in the Y direction of the head assembly 160 is performed when ink is sprayed. For example, when each of the head assemblies 160 sprays ink according to the ink spray time of the head assembly 160 stored in the memory 250, the ink droplets sprayed from the head assemblies 160 arrayed in the X direction may form a straight line parallel to the X direction.

Because a head assembly having a head of which height and rotation center are precisely adjusted is mounted in an inkjet printer, aspects of the present invention can improve array precision of the head assemblies, and can reduce time taken for arraying the head assemblies. In addition, because after the head assemblies are mounted in the inkjet printer, the positions in the X direction and rotation angles of the head assemblies are adjusted and the ink spray time for the gap in the Y direction is adjusted, the array precision of the head assemblies is more improved, and the time taken for arraying the head assemblies is more reduced.

Although a few embodiments of the present invention have been illustrated shown and described, it will be appreciated by those skilled in the art that changes may be made in this embodiment without departing from the principles and spirit of the present invention, the scope of which is defined in the claims and their equivalents.

What is claimed is:

1. A method for arraying head assemblies of an inkjet printer, the method comprising:

setting a reference height and a reference rotation center;

subsequently adjusting a height and a rotation center of a head coupled to a head assembly using the reference height and the reference rotation center;

subsequently mounting the head assembly in the inkjet printer; and subsequently adjusting a position of the head assembly and a rotation angle of the head assembly.

2. The method of claim 1, wherein the setting the reference height and the reference rotation center comprises:

attaching a reference jig to a rotation device of a preliminary array apparatus having a photographing unit and a flatness measuring unit disposed at a bottom thereof, the rotation device disposed at a top of the preliminary array apparatus;

adjusting the flatness of the reference jig using the flatness measuring unit;

measuring a height of the reference jig after adjusting the flatness of the reference jig;

setting the measured height of the reference jig as a reference height;

detecting a rotation center of the reference jig by rotating the rotation device; and setting the rotation center of the reference jig as a reference rotation center.

3. The method of claim 2, wherein the flatness measuring unit used for measuring the height of the reference jig comprises one of a laser displacement sensor and a dial gauge.

4. The method of claim 2, wherein the detecting the rotation center of the reference jig comprises:

perceiving a point of the reference jig;

rotating the reference jig approximately 360 degrees;

perceiving three points from a same trace of the rotation; and perceiving a center of a circle formed from the three points as the rotation center of the reference jig.

5. The method of claim 2, wherein the setting the rotation center of the reference jig as the reference rotation center comprises:

moving the photographing unit in the X, Y, and Z directions so that a center of the photographing unit is aligned with the rotation center of the reference jig.

6. The method of claim 1, wherein the adjusting the height and the rotation center of the head coupled to the head assembly comprises:

attaching the head assembly to a rotation device disposed at the top of a preliminary array apparatus having a photographing unit and a flatness measuring unit disposed at a bottom thereof;

aligning a center of the photographing unit with a rotation center of the rotation device;

measuring the height of the head after the adjusting the flatness of the head of the head assembly using the flatness measuring unit;

adjusting the height of the head of the head assembly to be the same as a predetermined reference height;

detecting the rotation center of the head of the head assembly by rotating the rotation device; and adjusting the rotation center of the head of the head assembly to be located at a predetermined reference rotation center.

7. The method of claim 6, wherein the adjusting the rotation center of the head of the head assembly comprises:

moving the head of the head assembly in the X and Y directions so that the rotation center of the head is aligned with the center of the photographing unit.

8. The method of claim 1, wherein the adjusting the position of the head assembly and the rotation angle of the head assembly comprises:

attaching the head assembly to a position adjusting member disposed at the top of the inkjet printer having a photographing unit disposed on a bottom thereof;

photographing the position of the head assembly in the X and Y directions and the rotation angle of the head assembly;

adjusting the position of the head assembly in the X direction and the rotation angle of the head assembly to be a predetermined reference position in the X direction and a reference rotation angle; and calculating ink spray time corresponding to the position of the head assembly in the Y direction of the head assembly and adjusting the ink spray time.

9. The method of claim 8, wherein the position adjusting member to which the head assembly is attached comprises:

an X direction moving portion allowing the head assembly to move in the X direction; and a rotating portion allowing the head assembly to rotate.

10. The method of claim 8, wherein the adjusting the position of the head assembly in the X direction and rotation angle of the head assembly is performed by the position adjusting member.

11. A method of controlling a head assembly array apparatus usable with an inkjet printer, the method comprising:

calculating an adjusting value in an X direction, a Y direction and a rotation angle of a head assembly;

controlling a Y direction moving member to move a sub-guide rail along a main guide rail to move a position adjusting member and the head assembly in the Y direction corresponding to the calculated adjusting value;

controlling the position adjusting member to move the head assembly in the X direction and to rotate the head assembly corresponding to the calculated adjusting value; and adjusting the ink spray time of the head assembly corresponding to an amount of error in the Y direction of the head assembly.

12. The method of claim 11, wherein the calculating the adjusting value comprises:

calculating a position of the head assembly in the X direction and the Y direction and the rotation angle of the head assembly corresponding to a photographing of the head assembly; and calculating the adjusting value according to the calculated position of the head assembly in the X direction and the Y direction and the calculated rotation angle of the head assembly.

13. The method of claim 12, wherein the calculating the adjusting value according to the calculated position of the head assembly in the X direction comprises:

calculating the spacing distance in the X direction between the head assembly and an other head assembly; and calculating the difference between a predetermined spacing distance and the calculated spacing distance to be the adjusting value in the X direction.

14. The method of claim 13, wherein moving the head assembly in the X direction comprises moving the head assembly the adjusting value in the X direction away from the other head assembly.

15. The method of claim 12, wherein calculating the Y direction and the rotation angle of the head assembly comprises:

calculating a position in the Y direction of the leftmost area of the head assembly;

calculating a position in the Y direction of the rightmost area of the head assembly; and calculating the rotation angle of the head assembly based upon the Y-direction of the leftmost area of the head assembly and the Y-direction of the rightmost area of the head assembly.

16. The method of claim 15, wherein calculating the adjusting value according to the calculated rotation angle comprises calculating the difference between a predetermined rotation angle and the calculated rotation angle to be the adjusting value according to the calculated rotation angle.

17. The method of claim 16, wherein the controlling the position adjusting member to rotate the head assembly comprises rotating the head assembly the calculated rotation angle.

18. The method of claim 11, wherein the photographing of the head assembly comprises moving a photographing unit in an X direction, Y direction and a Z direction to photograph the X direction, the Y direction and the rotation angle of the head assembly.

19. The method of claim 11, further comprising:

storing the calculated adjusting value and adjusted ink spray times; and displaying the photographed real time images of the head assemblies, a position calculating state, the calculated adjusting values, and a position adjusting state.

* * * * *